United States Patent [19]

Borkar et al.

[11] 4,143,346

[45] Mar. 6, 1979

[54] SELF CONVERGING, NORTH/SOUTH PIN CUSHION CORRECTED HYBRID YOKE

[75] Inventors: Suresh R. Borkar, Bombay, India; Wayne R. Chiodi, Northbrook, Ill.

[73] Assignee: Zenith Radio Corporation, Glenview, Ill.

[21] Appl. No.: 819,040

[22] Filed: Jul. 26, 1977

[51] Int. Cl.[2] ..... H01F 7/00

[52] U.S. Cl. ..... 335/213; 335/210

[58] Field of Search ..... 335/213, 210

[56] References Cited

U.S. PATENT DOCUMENTS

| | | | |
|---|---|---|---|
| 4,039,987 | 8/1977 | Talsma | 335/213 |
| 4,039,988 | 8/1977 | Clemens | 335/213 |
| 4,039,989 | 8/1977 | Staal et al. | 335/213 |

*Primary Examiner*—Harold Broome

*Attorney, Agent, or Firm*—Nicholas A. Camasto; Jack Kail

[57] ABSTRACT

A deflection yoke for a television picture tube having coplanar in-line electron guns includes vertical and horizontal coil windings selected for providing self-convergence and north/south pin cushion correction. The desired characteristics are achieved by winding the vertical coil for converging the electron beams along the vertical axis of the picture tube viewing screen and by winding the horizontal coil in a saddle configuration wherein an aperture devoid of wire turns is provided in the front end of the horizontal coil facilitating the achievement of a high third harmonic content winding distribution simultaneously with a comparatively high fifth harmonic content winding distribution.

4 Claims, 11 Drawing Figures

SELF CONVERGING, NORTH/SOUTH PIN CUSHION CORRECTED HYBRID YOKE

BACKGROUND OF THE INVENTION

The present invention relates to electromagnetic deflection yokes for use with television picture tubes.

Both color and monochrome picture tubes employ deflection yokes positioned to horizontally and vertically deflect the electron beam or beams over phosphor covered viewing screens. There are two common types of yoke winding configurations—saddle and toroidal. Frequently, different types of winding configurations are employed for the separate functions of horizontal and vertical deflection. Such an arrangement is commonly referred to as a hybrid yoke. The present invention relates specifically to hybrid yokes having saddle wound horizontal deflection coils.

Recently picture tubes having horizontal "in-line" electron guns, distinguished from the more traditional delta gun arrangement, and viewing screens with vertical phosphor strips have become popular, primarily because of the greater ease of obtaining convergence. In fact, hybrid yokes are known in the prior art which fully achieve beam convergence without the necessity of providing external correction. Furthermore, in addition to self-convergence, hybrid yokes are known in the prior art having north/south pincushion correction designed into the yoke's horizontal saddle coil.

The design parameters for achieving a self-converging, north/south pincushion corrected deflection yoke, which generally become more critical as the yoke deflection angle is increased, are generally well known in the art. The design parameters defining a deflection coil are normally represented in terms of the Fourier coefficients of the spatial distribution of wire turns density comprising the coil. The predominant coefficients are the first, third and fifth spatial harmonics of the expanded Fourier series. For convenience in dealing with the physical structure of a coil, these coefficients are frequently translated into corresponding moment angles. Thus, the coefficents corresponding to the third and fifth harmonics of the winding distribution essentially constitute, respectively, the first and second moment winding distribution parameters of the coil. In terms of the foregoing parameters, it is known that in order to achieve north/south pincushion correction it is necessary to wind the horizontal saddle coil having a winding distribution exhibiting a low first moment (also frequently referred to as the "center of gravity") or, stated otherwise, a large third harmonic content at the front of the coil, i.e. at its end adjacent the flared portion of the picture tube. Self-convergence is obtained by configuring the horizontal coil for converging the beams along the horizontal axis of the tube and by properly matching the coil configuration with a self-converging vertical coil (a vertical coil converging the electron beams on the vertical axis of the tube) to obtain convergence throughout the raster. The first requirement, convergence along the horizontal axis, is achieved by designing the horizontal saddle coil so that its winding distribution is characterized by a particular average first moment computed along the axial length of the yoke (corresponding to particular average third harmonic content) depending upon the specific geometry of the yoke-tube system. The second requirement, matching the horizontal saddle coil with a self-converging vertical coil to obtain convergence throughout the raster, is achieved by configuring the horizontal coil for exhibiting a winding distribution having a relatively large average second moment (frequently referred to as spread) or, correspondingly, a large average fifth harmonic content. Due to physical winding constraints, the large second moment parameter is typically incorporated into the back end of the horizontal coil if pincushion correction is designed into the coil's front end (i.e., a low first moment parameter). However, a saddle coil designed in this manner is relatively difficult to wind in that the initial turns laid down must extend between a point at the rear end of the coil having a large angular displacement from the horizontal plane passing through the central axis of the yoke to a point at the front of the coil having a relatively small angular displacement from the foregoing plane.

Other prior art attempts to achieve the foregoing design parameters, individually or in combination, have taken various forms. For example, in U.S. Pat. No. 3,849,749 to Kadota a yoke is disclosed having three axially spaced deflection coils, each coil being configured for producing an appropriate field such that the combined field suitably corrects pincushion and convergence distortions. In another embodiment, the Kadota patent illustrates the use of yoke half-sections tilted towards the tube screen for achieving the required fields. Other known approaches involve the use of magnetically permeable shims attached to the coils to appropriately influence the resulting magnetic fields as well as "denting" the coil in suitable locations, normally at the back end of the coil, thereby affecting the resulting center of gravity and/or spread.

However, in addition to designing a hybrid yoke exhibiting the above design parameters, it would also be highly desirable to provide a yoke wherein the horizontal saddle coil is rapidly and repeatably producible, for example, on a conventional tape controlled winding machine. Of course, the use of shims and dented coil sections would be unacceptable in such an application. In this regard, U.S. Pat. No. 3,855,694 to Van Der Heijde discloses the method of winding horizontal saddle coils in which the turns are distributed over a number of sections separated by void spaces or apertures by inserting one or more pins into the winding space during winding whenever the number of turns required for one section is obtained. Although this winding process is in and of itself attractive from a yoke manufacturability or windability viewpoint, the resulting coil does not exhibit the necessary magnetic characteristics for achieving north/south pincushion correction and self-convergence. In fact, the Van Der Heijde patent addresses the design problem of providing a yoke for a delta gun system, a solution for which would not be directly relatable to an in-line gun system.

SUMMARY OF THE INVENTION

It is an object of the present invention to provide a novel self-converging, north/south pincushion corrected deflection yoke for use with a television picture tube.

More specifically, it is an object of the present invention to provide an improved saddle configured horizontal coil for a television deflection yoke which is rapidly and repeatably manufacturable and which facilitates the achievement of self-convergence and north/south pincushion correction.

In accordance with the foregoing objects, a deflection yoke according to the present invention comprises a saddle shaped horizontal coil and a self-converging vertical coil suitably mounted on the neck of a television picture tube for deflecting the electron beams developed by the gun assembly of the tube across the tube's viewing screen. The horizontal coil is wound having a winding distribution exhibiting an average first moment for converging the beams along the horizontal axis of the tube. In addition, the horizontal coil's front end is characterized by a winding distribution simultaneously exhibiting a low first moment for achieving north/south pincushion correction and a comparatively high second moment whereby self-convergence is achieved.

DESCRIPTION OF THE PREFERRED EMBODIMENT

Figure 1:
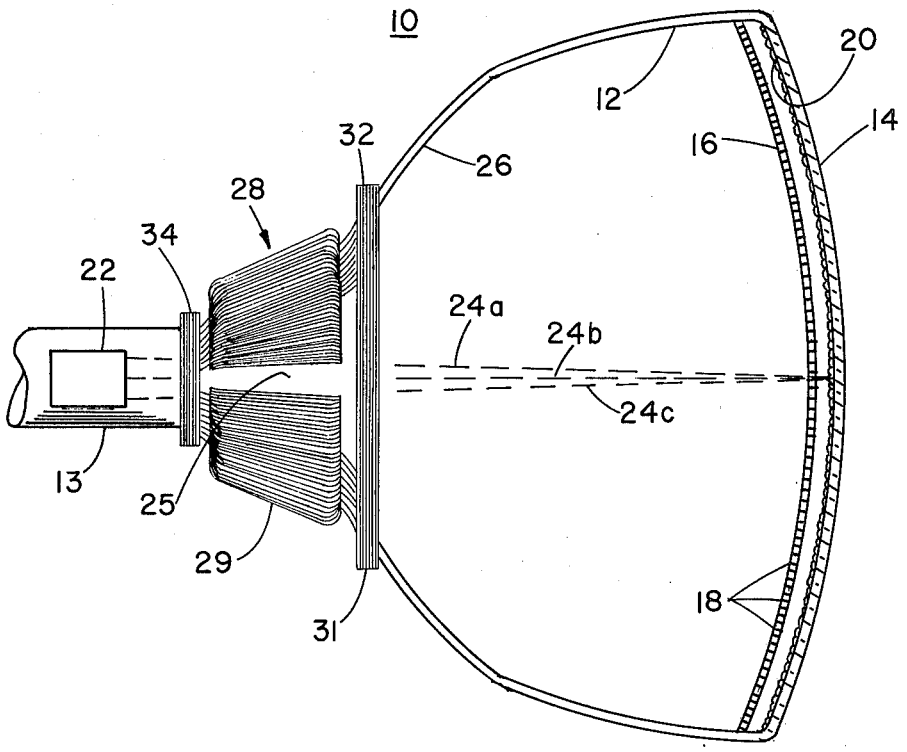
FIG. 1 is a top plan view in longitudinal cross-section of a color television picture tube including a deflection yoke according to the present invention.

Referring now to the drawings, FIG. 1 is a top plan view, in partial longitudinal cross-section, of a color television display system according to the present invention. A color television picture tube 10 includes an evacuated glass envelope 12, the front portion thereof constituting a viewing screen 14 and the rear portion a neck 13. A mask 16 having a plurality of apertures 18 is disposed within tube 10 adjacent a plurality of suitably colored phosphor strips 20 deposited on the inside surface of viewing screen 14. Neck 13 of glass envelope 12 suitably carries an electron beam gun assembly 22 which is constructed for producing three co-planar or in-line electron beams 24*a*, 24*b*, and 24*c*.

Disposed about the outside of glass envelope 12 along a flared portion 26 thereof is a deflection yoke assembly 28 constituting a toroidal vertical deflection coil 29 wound about a magnetically permeable core 25 and a saddle horizontal deflection coil 31. Deflection yoke 28 is adapted to be energized by a suitable source of scanning currents, not shown, for producing a magnetic field having horizontal and vertical components for deflecting electron beams 24*a*, 24*b*, and 24*c* causing them to appropriately impinge on phosphor strips 20, after passing through apertures 18 of mask 16, thereby forming a scanned raster on viewing screen 14. The vertical and horizontal components of the deflection field are induced by the vertical and horizontal deflection coils 29 and 31 respectively. Video information is reproduced on the screen by suitably amplitude modulating the electron beams as they are deflected by yoke 28.

Due largely to the physical arrangement of glass envelope 12, the raster developed on viewing screen 14 is subject to various well-known distortions when produced in response to a uniform yoke deflection field. Two common distortions are misconvergence and north/south pincushioning. Misconvergence occurs when the three electron beams emanating from gun assembly 22 converge at a point other than on the arcuate plane defined by mask 16. The result of misconvergence may be observably manifested by a somewhat blurred video reproduction or a misregistration of color information. North/south pincushioning is a type of distortion resulting in the production of a raster having top and bottom boundaries forming the shape of a pincushion. Both types of distortion are undesirable and must be corrected in order to achieve an acceptable video display system. While external circuits have been widely used in the past to reduce the effects of misconvergence and north/south pincushion distortion by suitably altering the deflection currents, there has been a recent emphasis on incorporating the necessary corrections directly into the yoke design. It is with this latter class of yokes that the present invention is concerned.

The analytical design parameters which must be satisfied in order to realize a self-converging, north/south pincushion corrected deflection yoke, although sometimes self-conflicting, are generally well known in the art. Thus, it is known that in order to achieve north/south pincushion correction of a deflection yoke it is necessary to wind the horizontal deflection coil such that its winding distribution exhibits a low first moment (a large third harmonic content) at its front end, i.e. at the coil end in the vicinity of flared portion 26 of envelope 12. Self-convergence is obtained by configuring the horizontal coil for converging the beams along the horizontal axis of the picture tube and by properly matching the coil with a self-converging vertical coil (a vertical deflection coil designed for converging the electron beams on the vertical axis of the tube). The foregoing is achieved by designing the horizontal coil such that it exhibits a winding distribution having suitable average first and second moments (corresponding to particular average third and fifth harmonic contents), the average second moment being relatively large in comparison to the average first moment. Due to the difficulty of simultaneously realizing low first moment and high second moment winding distribution parameters at the front end of the coil, prior art horizontal deflection coils are normally wound having a high second moment at the back end of the coil, i.e. the end nearest gun assembly 22.

Figure 2:
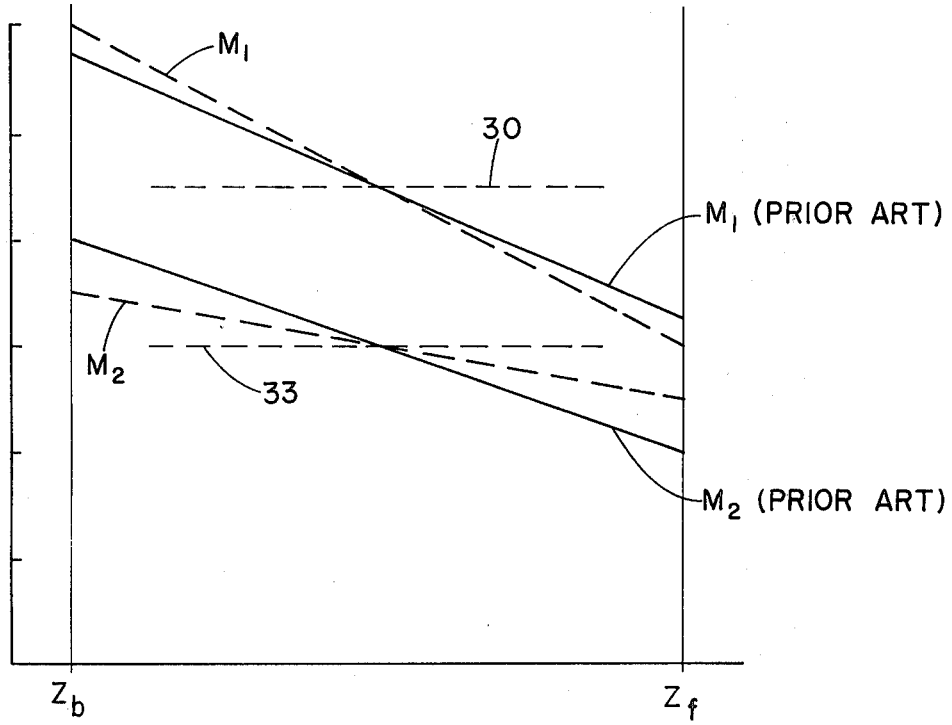
FIG. 2 graphically compares the first and second moment winding distributions of a prior art horizontal deflection coil with the same parameters of a horizontal coil according to the present invention.

FIG. 2 graphically illustrates exemplary first and second moment winding distribution parameters for the horizontal coils of two different self-converging, north/south pincushion corrected deflection yokes. For the moments $M_1$ and $M_2$ defined by the solid line curves, which represent the magnetic characteristics of a typical prior art horizontal deflection coil, it will be noted that the first moment winding distribution parameter $M_1$ is relatively low at the coil's front end (corresponding to abscissa $Z_f$) compared to its average value for the entire coil. This feature provides north/south pincushion correction. Similarly, for the moments $M_1$ and $M_2$ defined by the dashed line curves, which represent the magnetic characteristics of a horizontal deflection coil according to the present invention, the front end first moment winding distribution parameter $M_1$ is also relatively low compared to its average value. Furthermore, both first moment winding distribution parameters have approximately equal average values throughout the length of the horizontal coil as represented by dashed line 30. The latter characteristic of the yokes represented in FIG. 2 indicates that both horizontal coils suitably converge the electron beams along the horizontal axis of the picture tube. However, it will be noted that although possessing equal average values (as represented by dashed line 33) the second moment winding distribution parameters $M_2$ differ considerably between the two horizontal coils. Fundamentally, it will be observed that the second moment winding distribution parameter $M_2$ at the front end (abscissa $Z_f$) of a coil constructed according to the present invention much more nearly approaches the coil's front end first moment winding distribution parameter $M_1$ than in the case of the prior art coil. That is, a horizontal coil fabricated according to the present invention exhibits, at its front end, a comparatively high second moment winding distribution parameter $M_2$ relative to its first moment winding distribution parameter $M_1$. Although the foregoing characteristics have heretofore been generally considered incompatible, they are nevertheless achieved in a coil wound according to the present invention in a straightforward and readily repeatable manner.

Figure 3:
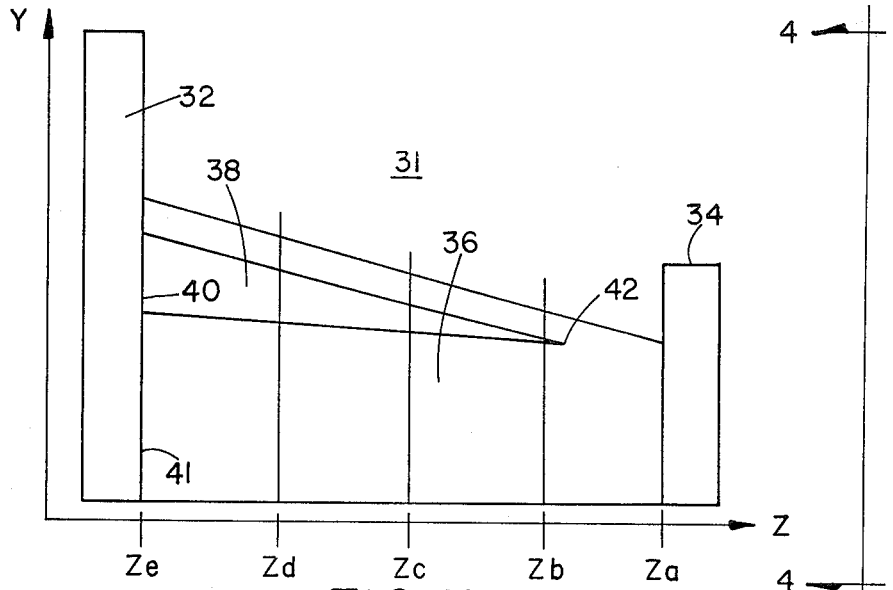
FIG. 3 is a side elevation view of a horizontal saddle-type deflection coil according to the present invention.
Figure 4:
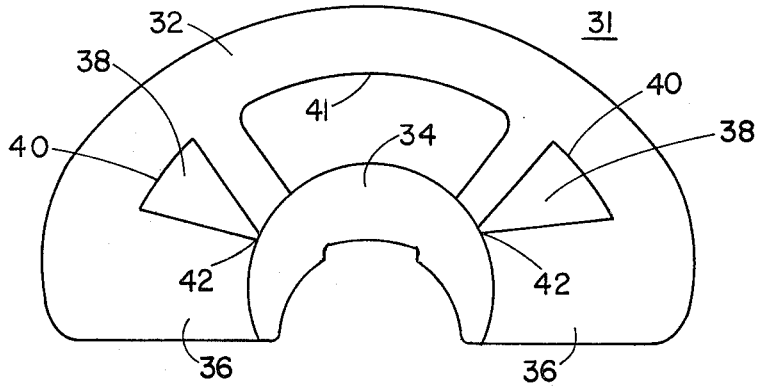
FIG. 4 is an end view taken along line 4—4 of FIG. 3.

A saddle wound horizontal deflection coil according to the present invention is illustrated at 31 in FIGS. 3 and 4. Coil 31 constitutes a plurality of wire turns wound forming a forwardly disposed arcuate portion 32 comprising a first series of transversely disposed end turns, a rearwardly disposed arcuate portion 34 of decreased dimension comprising a second series of transversely disposed end turns and an active magnetic field producing intermediate section 36 extending between arcuate portions 32 and 34. In use, coil 31 is disposed about neck 21 of picture tube 10 with its abscissa or Z-axis parallel with the longitudinal central axis of the tube. Arcuate portion 32 of coil 31 is in abutment with flared portion 26 of glass envelope 12 and, in association with the forwardly disposed portion of intermediate section 36, defines the front end of coil 31. Similarly, arcuate portion 34 in association with the rearwardly disposed portion of intermediate section 36 defines the back end of coil 31. Finally, it will be noted that intermediate section 36 includes a triangularly shaped aperture 38 void of wire turns and having a base 40 extending adjacent the interior edge or surface 41 of arcuate portion 32 and an apex 42 disposed part way down intermediate section 36 toward arcuate portion 34. As will be explained in further detail hereinafter, it is the judicious placement of aperture 38 which enables coil 31 to be characterized by, at its front end, a winding distribution simultaneously having a relatively low first moment $M_1$ and a comparatively high second moment $M_2$ to facilitate the realization of self-convergence and north/south pincushion correction.

Figure 5A:
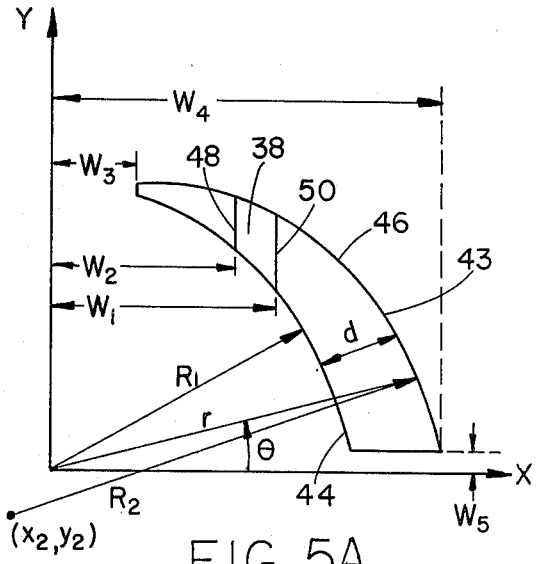
FIGS. 5A and 5B illustrate, respectively, a typical cross-sectional view taken along a plane perpendicular to the Z-axis at a point near $Z_d$ in FIG. 3 and its corresponding turns density distribution.

FIG. 5A illustrates a typical cross-section of coil 31 taken along a plane perpendicular to the Z-axis (see FIG. 3) and parallel to the ordinate or Y-axis at the front end of the coil, e.g. between the points $Z_d$ and $Z_e$. It will be observed that the cross-section consists of a wedge-shaped boundary 43 defined by an inner arc 44 having a radius $R_1$ extending from the origin of the coordinate system and an outer arc 46 having a radius $R_2$ extending from a point $(x_2, y_2)$. A radius r subtending an angle $\theta$ extends from the origin and also defines outer arc 46. Wedge-shaped boundary 43 is vertically truncated or terminated on one side at a point spaced by a dimension $W_3$ from the Y-axis and horizontally on its other side at a point spaced by a dimension $W_5$ from the X-axis. Finally, the boundary includes aperture 38 disposed between a pair of vertical edges 48 and 50 spaced from the Y-axis by a pair of dimensions $W_2$ and $W_1$ respectively.

Figure 5B:
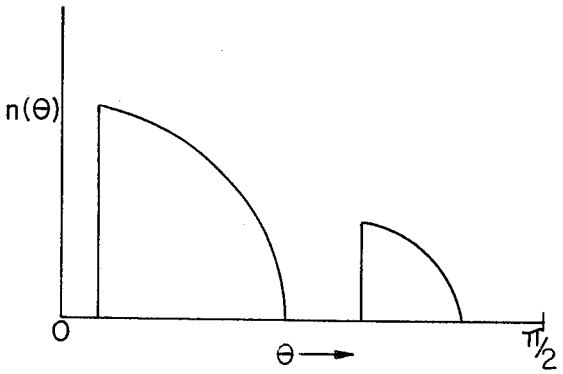

It will be understood that the thickness d, where $d = r - R_1$, of wedge-shaped boundary 43 illustrated in FIG. 5A relates to, for any angle $\theta$, the turns density n $(\theta)$ of coil 31. This relationship is illustrated in FIG. 5B which graphically depicts the turns density n $(\theta)$ as a function of angle $\theta$ for the typical cross-section of FIG. 5A. Mathematically, the turns density n $(\theta)$ is given by the following expression:

$$n(\theta) = (N/2A)(r^2 - R_1^2),$$

for $W_3 \leqq x \leqq W_2$ $$n(\theta) = (N/2A)(r^2 - R_1^2),$$

for $W_1 \leqq x \leqq W_4$ $$n(\theta) = 0,$$

for elsewhere;

where N = total number of turns, and $$A = \int_0^{\pi/2} n(\theta)\, d(\theta).$$

The previously mentioned first moment winding distribution parameter $M_1$, which is related to the third harmonic content of the deflection field, may be expressed in terms of the foregoing functions as follows:

$$M_1 = \frac{1}{A} \int_0^{\pi/2} \theta n(\theta)\, d\theta.$$

Similarly, the second moment winding distribution parameter $M_2$, which is related to the fifth harmonic content of the deflection field, is given by the expression:

$$M_2 = \sqrt{\left(\frac{1}{A} \int_0^{\pi/2} \theta^2 n(\theta)\, d\theta\right) - (M_1)^2}\ .$$

Analysis of the foregoing expressions reveal that the first moment winding distribution parameter $M_1$ may be considered the center of gravity of a transverse cross-section of the coil conductors. Thus, in a coil having a front end winding distribution exhibiting a low first moment $M_1$ for providing north/south pincushion correction, a large proportion of the turns are located in relatively close proximity to the X-axis. On the other hand, the second moment winding distribution parameter $M_2$ may be considered the moment of inertia about the first moment or center of gravity $M_1$ and is therefore frequently referred to as the spread of conductors about the first moment $M_1$. It follows, that in order to provide a coil having a high front end second moment $M_2$, to facilitate self-convergence, the conductors should be suitably spread over a relatively wide angle $\theta$. It will be appreciated that the foregoing design criteria are generally conflicting in that one requires that the conductors be bunched relatively close to the X-axis whereas the other at the same time requires that the conductors be widely spread over a relatively large angle $\theta$.

The foregoing apparent conflict is largely eliminated by the horizontal saddle coil of the present invention through the judicious placement of aperture 38 in intermediate coil section 36. That is, by suitably locating aperture 38 which, of course, corresponds to the segment of wedge-shaped boundary 43 having a turns density $n(\theta) = 0$, it is possible to construct coil 31 having a front end winding distribution simultaneously characterized by a low first moment $M_1$ and a high second moment $M_2$. Conceptually, the inclusion of aperture 38 allows the conductors to have a relatively wide spread in the quadrant represented by FIG. 5A while at the same time the larger proportion of conductors are located comparatively near the X-axis. In this manner, a front end coil winding distribution is achieved providing both north/south pincushion correction and self-convergence.

A convenient measure of the effectiveness of a horizontal deflection coil's capacity for achieving north/south pincushion correction and self-convergence as well as the windability thereof is the ratio of the coil's front end second moment winding distribution parameter $M_2$ to its front end first moment winding distribution parameter $M_1$, i.e. $M_2/M_1$. In prior art deflection yoke designs the ratio $M_2/M_1$ is typically between about 0.64–0.73. It has been found, however, that in a horizontal coil having a front end design for achieving north/south pincushion correction and self-convergence the ratio $M_2/M_1$ is preferably at least about 0.80. In other words, assuming that a particular value of the first moment winding distribution parameter $M_1$ is needed to achieve north/south pincushion correction, the second moment $M_2$ should be maximized so that the ratio $M_2/M_1$ is at least about 0.80. As discussed above, the judicious placement of aperture 38 provides a suitable facility for accomplishing such and results in a conveniently windable coil.

A preferred embodiment of horizontal saddle coil 31 constructed according to the present invention is shown in FIGS. 6A–6E which illustrate a series of coil cross-sections similar to that shown in FIG. 5A and which are taken at the point $Z_a$–$Z_e$ in FIG. 3. It will be noted that as the plane of the section is moved from point $Z_a$ to point $Z_e$ (from the back to the front end of coil 31), that is, from FIG. 6A to FIG. 6E, the size of aperture 38 gradually becomes larger and the ratio of $M_2$ to $M_1$ increases. Finally, at the front end of the coil, e.g. FIG. 6E, the second moment $M_2$ is at its highest level relative to the value of the first moment $M_1$.

Figure 6A:
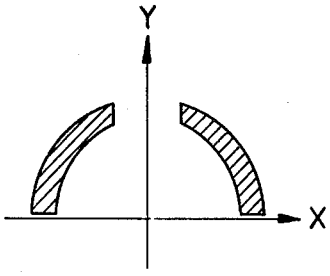
FIGS. 6A–6E are cross-section views similar to FIG. 5A but taken along the planes perpendicular to the Z-axis at points $Z_A$–$Z_E$ respectively in FIG. 3.
Figure 6B:
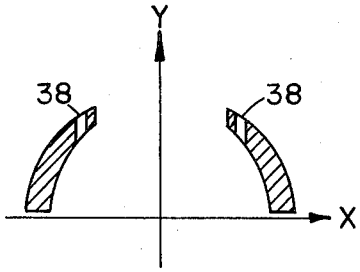
Figure 6C:
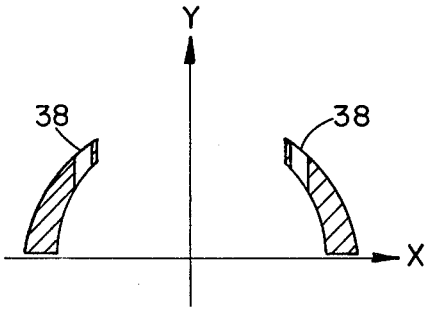
Figure 6D:
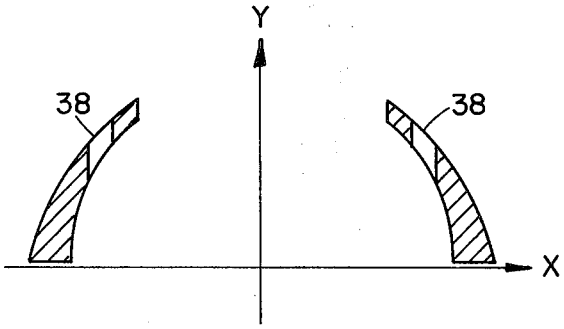
Figure 6E:
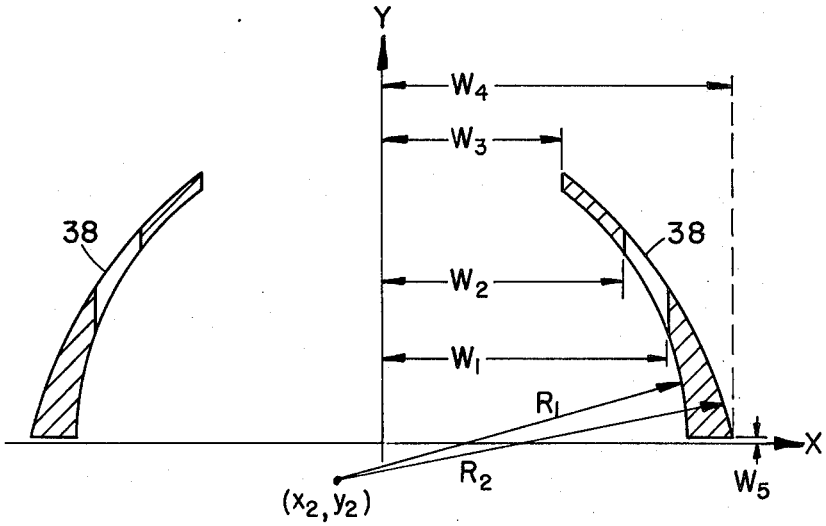

The cross-sections of FIGS. 6A–6E correspond to a horizontal saddle deflection coil wherein the length of intermediate section 36 from point $Z_a$ to point $Z_e$ is approximately 2.100 inches. The parameters shown in FIG. 6E are sufficient for uniquely defining each cross-section and are tabulated below for convenience. In the table, points $Z_a$–$Z_e$ correspond to $Z = 0, 0.5, 1.0, 1.5$ and 2.1 respectively. In addition, the table provides the design parameters for various values of Z intermediate the foregoing values for purposes of completeness. The coil defined by the table is suitable for use with a 25 inch picture tube and a deflection yoke having a 100° deflection angle. At the coil front end the calculated first moment winding distribution parameter $M_1$ is 17.3° and the second moment winding distribution parameter $M_2$ is 15.5° so that the ratio $M_2/M_1$ is equal to about 0.90. A substantially similar coil fabricated for a 19 inch picture tube was found to exhibit a first moment winding distribution parameter $M_1$ of 18.2° and a second moment winding distribution parameter $M_2$ of 15.5° wherein the ratio $M_2/M_1$ is about 0.85.

| Z | $R_1$ | $X_2$ | $Y_2$ | $R_2$ | W1 | W2 | W3 |
|---|---|---|---|---|---|---|---|
| 0 | .624 | .034 | −.005 | .739 | .361 | .361 | .238 |
| .150 | .655 | .061 | −.003 | .751 | .426 | .405 | .307 |
| .300 | .687 | .079 | −.007 | .771 | .485 | .445 | .375 |
| .450 | .718 | .094 | −.014 | .796 | .539 | .483 | .440 |
| .500 | .728 | .098 | −.018 | .805 | .557 | .495 | .461 |
| .600 | .749 | .104 | −.028 | .827 | .593 | .521 | .502 |
| .750 | .782 | .108 | −.050 | .872 | .652 | .564 | .561 |
| .900 | .830 | .100 | −.083 | .948 | .720 | .616 | .617 |
| 1.000 | .874 | .085 | −.114 | 1.024 | .774 | .658 | .653 |
| 1.050 | .901 | .074 | −.132 | 1.069 | .803 | .682 | .671 |
| 1.200 | .999 | .025 | −.197 | 1.244 | .905 | .764 | .721 |
| 1.350 | 1.122 | −.051 | −.278 | 1.467 | 1.028 | .866 | .769 |
| 1.500 | 1.263 | −.155 | −.374 | 1.741 | 1.172 | .987 | .827 |
| 1.650 | 1.428 | −.284 | −.478 | 2.063 | 1.336 | 1.124 | .896 |
| 1.800 | 1.617 | −.426 | −.578 | 2.412 | 1.514 | 1.274 | .980 |
| 1.950 | 1.820 | −.549 | −.649 | 2.741 | 1.706 | 1.437 | 1.080 |
| 2.100 | 2.036 | −.664 | −.709 | 3.074 | 1.911 | 1.613 | 1.199 |

What has been shown is a unique horizontal saddle deflection coil which, when incorporated into a deflection yoke having a self-converging vertical deflection coil, provides north/south pincushion correction as well as self-convergence. These distortions are eliminated by the horizontal coil due to its front end conductor winding distribution wherein a low first moment is achieved simultaneously with a comparatively high second moment. Advantages attributable to incorporating the distortion reducing design into the front end of the coil include the use of well known conductor winding techniques wherein the horizontal saddle coil is rapidly and repeatably producible, for example, on a conventional tape controlled winding machine.

While there have been described particular embodiments of the present invention, it will be apparent that changes and modifications may be made therein without departing from the invention in its broader aspects. The aim of the appended claims, therefore, is to cover all such changes and modifications as fall within the true spirit and scope of the invention.

What is claimed is:

1. A deflection yoke for use in a color image display system of the type including a picture tube having an electron gun assembly for producing a plurality of coplanar in-line beams which are scanned for producing a raster on the viewing screen of said picture tube, said yoke comprising:

a pair of vertical deflection coils adapted for converging said beams along the vertical axis of said screen; and a pair of saddle shaped horizontal deflection coils each having average first and second moment winding distribution parameters selected for converging said beams on said screen;

said pair of saddle shaped horizontal deflection coils each having a front end winding distribution simultaneously exhibiting a relatively low first moment winding distribution parameter $M_1$ for north/south pincushion correcting said deflection yoke and a high second moment winding distribution parameter $M_2$, relative to said low first moment, for facilitating convergence of said beams by said deflection yoke throughout said raster.

2. A deflection yoke according to claim 1 wherein said saddle shaped horizontal deflection coils each comprise a plurality of wire turns wound forming a plurality of substantially transverse front end turns, a plurality of substantially transverse rear end turns and an intermediate section joining said front and rear end turns, said intermediate section being formed having an aperture void of wire turns at a selected position near said front end turns for enabling realization of said low first moment winding distribution parameter $M_1$ and said high second moment winding distribution parameter $M_2$.

3. A deflection yoke according to claim 2 wherein said aperture is configured and positioned such that said first and second moment winding distribution parameters $M_1$ and $M_2$ are characterized in that the ratio $M_2/M_1$ is equal to at least about 0.80.

4. A deflection yoke according to claim 3 wherein said aperture forms a triangularly shaped boundary void of interior wire turns having a base extending along a portion of the interior surface of said front end turns and an apex disposed part way down said intermediate section toward said rear end turns.

* * * * *